United States Patent [19]

Prevot et al.

[11] Patent Number: 4,749,965

[45] Date of Patent: Jun. 7, 1988

[54] MINIATURIZED GYROMAGNETIC DEVICE

[75] Inventors: Julien Prevot, Osny; Kamel Chabani, Montreuil; Michel Courgeon, Boisemont; Denis Duquenoy; Roger Duquenoy, both of Livry Gargan; Regis Le Navenec, Gonesse, all of France

[73] Assignee: Thomson CSF, Paris, France

[21] Appl. No.: 942,839

[22] Filed: Dec. 17, 1986

[30] Foreign Application Priority Data

Dec. 20, 1985 [FR] France ..... 85 18986

[51] Int. Cl.[4] ..... H01P 1/387

[52] U.S. Cl. ..... 333/1.1; 333/246; 333/24.2

[58] Field of Search ..... 333/1.1, 24.2

[56] References Cited

U.S. PATENT DOCUMENTS 3,414,843 12/1968 Jansen ..... 333/1.1
3,510,804 5/1970 Hashimoto et al. .
3,621,476 11/1971 Kanbayashi .
3,739,302 6/1973 McManus .
4,209,756 6/1980 Jin et al. .
4,246,552 1/1981 Fukasawa et al. .
4,276,522 6/1981 Coerver ..... 333/1.1

FOREIGN PATENT DOCUMENTS 123220 9/1980 Japan ..... 333/1.1
63914 4/1982 Japan ..... 333/1.1

*Primary Examiner*—Paul Gensler
*Attorney, Agent, or Firm*—Cushman, Darby & Cushman

[57] ABSTRACT

A miniaturized and integrated gyromagnetic device in which a center conductor is mounted between a pair of dielectric wafers and ferrite conductors to define a circular inner configuration. A pressure washer is welded to a square casing and mounts a magnet, the wafers, ferrite conductors and a pair of ground plates to absorb thermal expansion during operation.

5 Claims, 4 Drawing Sheets

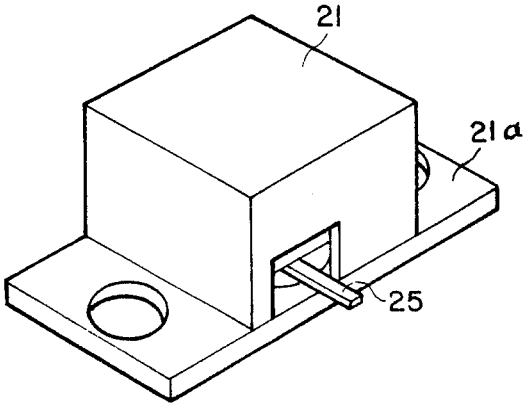
FIG_4
FIG_3
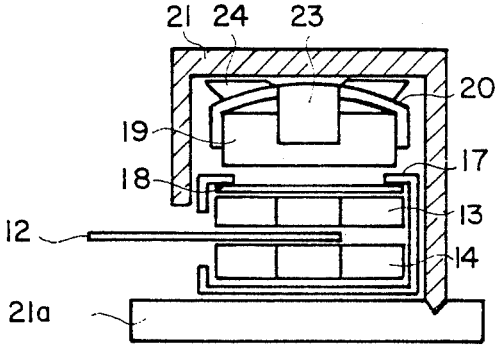
FIG_5
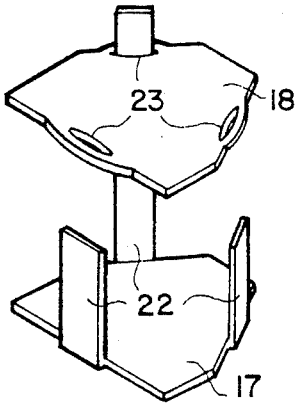
FIG_6
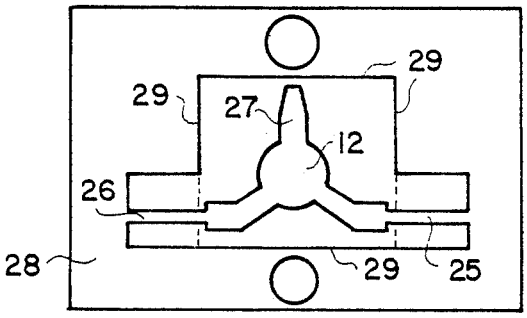

MINIATURIZED GYROMAGNETIC DEVICE

BACKGROUND OF THE INVENTION

The present invention pertains to a miniaturized and integrated gyromagnetic device and its method of assembly. The gyromagnetic device of the invention is used in the field of ultra-high frequencies ranging from 1 to more than 40 GHz. The term "integrated" implies that this device forms an entire unit which, when completed, can no longer be dismantled except to be destroyed: it therefore, forms a whole which may be considered to be an elementary ultra-high frequency component.

Ultra-high frequency devices are undergoing much development, partly because they are being increasingly used in all fields (such as telecommunications, radar, satellites, etc.) where electrical signals are transmitted in the form of waves within or beyond the atmosphere, and also because they have forms which are easier to use than tubes and metallic waveguides. Ultra-high frequency sources are currently semi-conducting chips (at least for small power values) and the waveguides are microstrips. This means that it is possible to manufacture circuits which may be hybrid or integrated but will be compact in all cases.

However, the manufacture of certain ultra-high frequency components such as gyromagnetic components, circulators, gyrators, phase shifters etc., which combine a conductive core and at least one ferrite element and one magnet, calls for high-precision mechanical assembly: 1/100th of a millimeter on the respective thicknesses and positions, a requirement which implies difficulties in assembly and high costs.

SUMMARY OF THE INVENTION

The gyromagnetic device according to the invention has been designed for easy assembly according to a simple and, therefore, swift and inexpensive method.

Furthermore, one object of the invention is to have a miniaturized, ultra-high frequency component because the design of such a component eliminates all mechanical means such as screws for assembly: being miniaturized, it can be integrated into a hybrid circuit.

Another object of the invention is to provide for means designed to absorb thermal expansion during the operation of the device. When these compensation means are not provided for, the ferrite elements can break.

The gyromagnetic device according to the invention comprises conventional parts: a conducting core fitted with external connectors, at least one ferrite element and one absorbing block, at least one magnet and an internal ground, the entire unit being mounted in a casing. In this device, the parts which must be assembled and positioned with precision (especially the core and the ferrite elements) form a whole clamped between two internal ground parts fitted with reciprocal fixing means, the external or internal shapes of these different parts being complementary to one another, thus providing for precise positioning.

The invention also comprises the magnet positioning part which is a pressure washer that is not flat, the elasticity of which absorbs thermal expansions.

The method for assembling the gyromagnetic device according to the invention comprises a simple stacking of parts, the external and internal shapes of which automatically enable them to be correctly positioned.

Again, in the invention, when the parts are stacked in the casing, a single electric welding of the lid to the casing closes the gyromagnetic device and makes it an integrated component.

More precisely, the invention pertains to a miniaturized and integrated gyromagnetic device comprising, within a casing closed by a base plate, one conducting core, two ferrite wafers, one internal ground and one magnet, a gyromagnetic device wherein the conducting core and the two ferrite wafers are held so that they are integrally joined to each other and precisely positioned by two internal ground plates, made of non-magnetic material, one of these plates having tongues which fit into the slits formed in the other plate, providing for reciprocal fastening to clamp the core and the ferrite wafers.

BRIEF DESCRIPTION OF THE DRAWINGS

The invention will be better understood from the following description of an example of an embodiment, based on the appended figures of which:

FIG. 3 is a cross-section of a gyromagnetic device according to the invention

FIG. 4 is a three-quarter view of a gyromagnetic device according to the invention.

FIG. 5 is a three-quarter view of the two internal ground elements.

FIG. 6 is a plane view of the element out of which the core is cut.

DETAILED DESCRIPTION OF THE INVENTION

To simplify the text, the invention will be explained by using the example of an isolator but without, in any way, restricting the scope of the invention which pertains to any gyromagnetic device.

Figure 1:
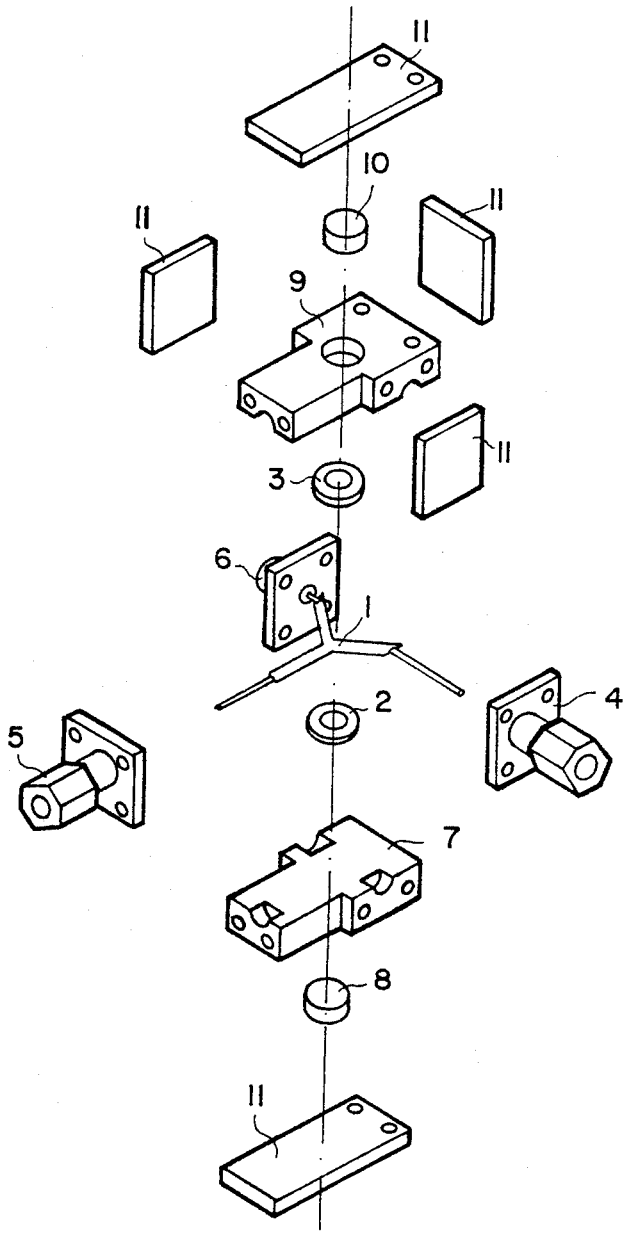
FIG 1 PRIOR ART
FIG. 1 is an exploded view of a gyromagnetic device according to the prior art.

A preliminary remainder of the structure of a gyromagnetic isolator according to the prior art will provide a better understanding of the basis and advantages of the gyromagnetic device according to the invention. FIG. 1 gives an exploded view of an isolator according to the prior art.

An isolator comprises a core 1. This core is a metallic part shaped like a star with three arms at 120°, held between two wafer-shaped ferrite parts 2 and 3. Two arms of the core 1 end in coaxial connectors 4 and 5 which constitute the isolator's external connectors and the third arm is linked to an absorbing block 6, which is a resistor, one end of which is grounded. The unit formed by the metallic core 1 and the two ferrite wafers 2 and 3 is clamped between two parts 7 and 9 forming a ground plane. The thickness of these two parts 7 and 9 is sufficient for two magnets 8 and 10 to be housed in them. In addition, the thickness of the two parts 7 and 9 forming the ground plane is such that they can be used as a protective casing for the isolator, the coaxial external connectors 4 and 5 and the connector base plate 6 which contain the absorbing block being then used as a means of fixing the two base plates to each other by means of the fixing screws of the coaxial connectors. The casing is completed by steel plates 11 which are bonded to all the surfaces where there is no coaxial connector base plate: these steel plates 11 are used firstly, to make the device relatively impervious in order to keep out any dust when might create a short circuit and, secondly, to form a magnetic shield around the isolator.

Modes of embodiment of an isolator, other than the one depicted in FIG. 1, exist and are known: however, as a general rule, the various constituent elements, and especially the core and ferrite wafers, are first joined to one another by means of a bonding coat: this joining is a very difficult operation since the parts of an isolator having to be assembled with a positioning precision of about 1/100th mm.

Furthermore, it is observed that no part can be used to compensate for the thermal expansion when the isolator is in operation since the external as well as the internal dimensions are laid down by the coaxial connector base plates, 4, 5 and 6, which fix the positions of the two ground plane parts 7 and 9. Finally, the assembly of an isolator of this type is a relatively prolonged operation in which, first, the parts have to be bonded in the correct position and, then, the coaxial connectors have to be screwed into the previously bonded central part.

Figure 2:
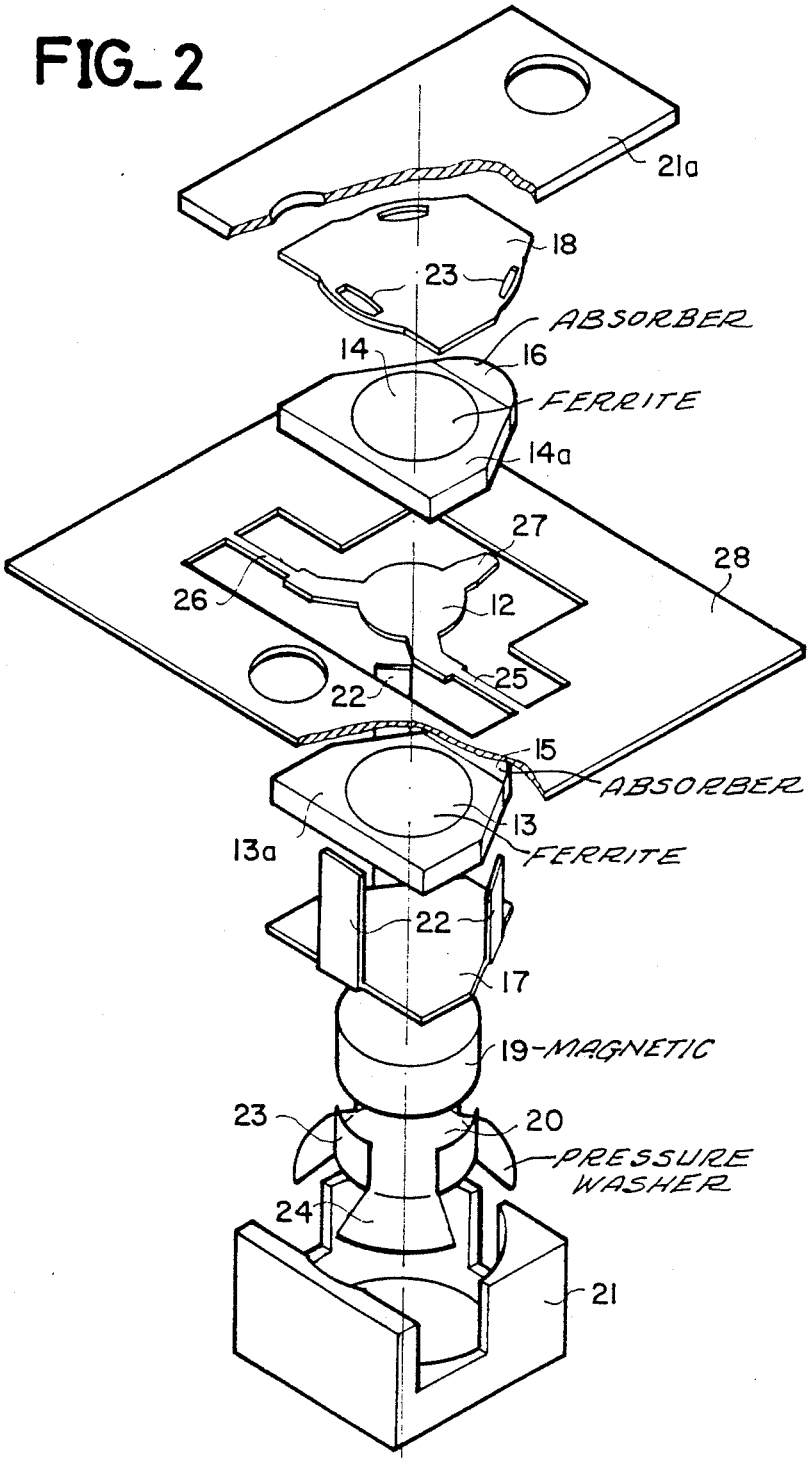
FIG. 2 is an exploded view of a gyromagnetic device according to the invention.

These various disadvantages are eliminated by the gyromagnetic isolator which is the object of the present invention, an exploded view of which is given in FIG. 2.

The function of the various parts that constitute this isolator according to the invention is comparable to the function of the parts constituting an isolator according to the prior art, but their external shape is adapted so that assembly and the precise positioning of each part are made easier.

An isolator according to the invention comprises a metallic conducting core 12 which is held between two ferrite wafers 13 and 14. These ferrite wafers are themselves integrally joined to the absorbing blocks 15 and 16 and to the dielectrics 13*a* and 14*a*. The external shape of the dielectric wafers 13*a* and 14*a* corresponds to an isosceles triangle, each vertex of which is truncated: the positioning of two truncated vertices corresponds to the outputs of the isolator according to the invention, through metallic strips, and the third truncated vertex corresponds to the arm of the core 12 which conducts ultra-high frequency power towards the absorbing blocks 15 and 16.

All of these three parts, i.e. the conducting core 12 and the two sub-assemblies, ferrite wafer+dielectric wafer+load, 13+13*a*+15 and 14+14*a*+16 are held in contact with one another by means of two copper or brass parts 17 and 18 which constitute the internal ground of the device. FIG. 2 depicts an isolator with its form of assembly: to hold the three above-mentioned parts together and to position them in relation to one another, the wafer 13*a* finds a place between three lugs 22 of the lower ground 17, then the core 12 is superimposed on the wafer 13*a* and the wafer 14*a* takes its place between the three lugs 22 of the lower ground: on this stack is laid the upper ground plate 18 which has three holes 23, the shape and position of which are suited to enable the tongues 23 to go through them. When the stacking is done, it is enough to twist and fold back the tongues 22 to make a precisely pre-positioned assembly. For the two internal ground plates 17 and 18 are also triangular shaped, with truncated vertices, this triangular shape corresponding to the triangular shape of the wafers 13*a* and 14*a*, the entire assembly being machined and fitted with a precision of about 1/100th mm.

The positioning of the metallic core 12, which does not have an external triangular shape with truncated vertices, will be explained below along with the assembling procedure.

In addition, the isolator according to the invention comprises a magnet 19 which is held in position by means of a washer 20 in the casing 21 of the device. This casing 21 is closed, when the assembly is completed, by means of a plate 21*a*, the parts 21 and 21*a* being made of steel.

The washer 20 is a pressure washer and is therefore made of steel, bronze or beryllium, and comprises means 23 to hold and center the magnet 19, these means being folded on one side of the main plane of the washer 20, and means 24 giving it elasticity with which to compensate for thermal expansion or to absorb expansion when the isolator is closed by electrical welding, these means 24 being made up of tongues folded on another side of the main plane of the washer 20.

The conducting metal core 12 comprises two arms 25 and 26 providing external connections to the isolator. These two arms are made up of microstrips. The core also comprises an arm 27 which, inside the completed device, is located between the two absorbing blocks 15 and 16. Furthermore, as depicted in this FIG. 2, the core is handled in the form of a frame 28 into which the core as such is cut by chemical means. This frame 28 is used to center the core in relation to the ferrite wafers.

FIG. 3 depicts a cross-section view of an isolator according to the invention when the parts of FIG. 2 are assembled and compressed. The FIG. 3 is only inverted with respect to FIG. 2, i.e. it lies on its base plate 21*a*, as is normal, while FIG. 2 corresponds to the stacking of parts in the casing 21, i.e. when an isolator is being made.

FIG. 4 represents a three-quarter view of a finished isolator: by way of example, while the isolator of the prior art in FIG. 1 is an object approximately three centimetres square with a thickness of one and a half centimetres, with access provided by coaxial connectors, the isolator according to the invention is an object which is substantially cubical in shape, about 6 mm. on each side, incapable of being dismantled because it is electrically welded, provided with a base plate 21*a* which is just big enough to be screwed or bonded to a hybrid circuit. The small dimensions make it possible to connect microstrips 25 and 26 to an external circuit without having to use coaxial connectors.

FIG. 5 depicts a three-quarter view of the two internal ground parts 17 and 18. As we have said earlier, these two parts are made of a material such as copper or brass, and both of them are broadly shaped like isosceles triangles, the vertices of which are truncated. But one of these two parts, the part 17 for example, is fitted with tongues 22 which are cut out of the same plate as the part 17, these tongues being folded at right angles and one of them being longer than the others so that the unit can be handled with forceps. The other internal ground part, the part 18, is provided with slit-shaped holes 23, the position and dimensions of which correspond to the tongues 22. When the core 12 and the ferrite parts 13 and 14 as well as the absorbing blocks 15 and 16 are positioned between the two internal ground parts 17 and 18, it is enough to lower the part 18 by making it slide along the longest of the tongues 22 to form a sandwich of parts, and then to fold the tongues 22 to form a compact and easily handled unit. Of course, the dimensions of the parts 17 and 18 are calculated so that the dielectric parts 13*a* and 14*a*, which are stacked between the tongues, are positioned to a precision of within the nearest hundredth of a millimetre.

It can be seen that the assembly and positioning of all these parts no longer requires any bonding.

FIG. 6 represents a plane view of the frame 28 into which the core 12 is cut. This frame 28, which is manufactured in batches, by a chemical cutting-out process, has the specific feature of comprising an internal cut-out, surrounding the core 12 with its arms 25, 25 and 27, the edges 29 of this cut-out corresponding to the external shape of the casing 21 of the isolator according to the invention. Thus, while the dielectric parts 13*a* and 14*a* are centered by means of their external edges with respect to the ground plane parts 17 and 18, the conducting core 12 is, for its part, centered by means of the internal edge of its frame with respect to the external edge of the casing.

Figure 7:
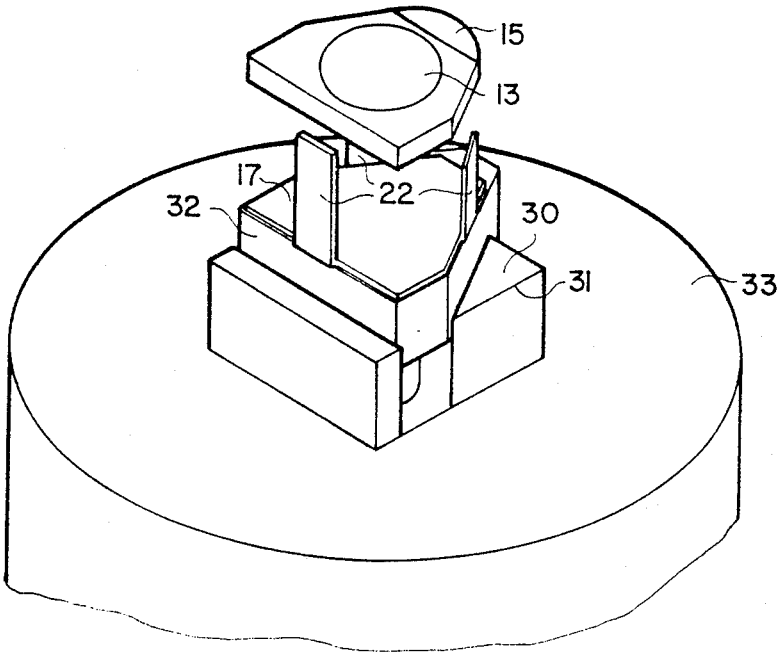
FIG. 7 is a three-dimensional view of the dummy for pre-assembling parts which have to be positioned with precision.

FIG. 7 depicts a three-dimensional view of the dummy for the pre-assembling of the parts which have to be positioned: this figure will make it easier to understand the operations of the method for assembling the isolator according to the invention, as well as the centering of the core 12 and the role played by the metallic frame 28 in this centering.

To pre-assemble all the parts 12, 13, 14, 17 and 18, which must be assembled with a precision of about one hundredth of a millimetre, a dummy 30 is used with the same external contour 31 as the casing 21 of the device. Inside its volume, this dummy 30 has an extractor 32 which goes through the socket of a mounting tool 33. In the example of FIG. 7, the extractor 32 is depicted in the top position only so that it can be seen.

The method for assembling a gyromagnetic device according to the invention consists in stacking the parts in the following order on the mounting tool of FIG. 7, the extractor 32 being in the bottom position:

The lower ground plane 17

A ferrite wafer 13 and the dielectric wafer 13*a* with its absorbing block 15, The core 12 supported by its metallic plate 28, A ferrite wafer 14 and the dielectric wafer 14*a* with its absorbing block 16, The upper ground plane 18.

The triangular shaped parts with truncated vertices are automatically stacked inside the dummy 30: it can therefore be said that they are centered with respect to one another through their external contour. By contrast, the core 12 which does not have a triangular shape is centered on the external contour 31 of the dummy 30 by means of the internal contour 29 of the cut-out in the frame 28.

When all these parts are positioned in the correct order, it is enough to exert slight pressure on them and to twist the lugs 22 which are integrally joined to the ground plate 17 to form a compact, homogeneous and easily handled unit.

This compact, homogeneous and pre-positioned unit is extracted from the mounting dummy 30 and is brought as an entire piece into the assembly of the gyromagnetic circuit according to the invention.

This assembling operation consists in laying the following parts within the casing 21:

The washer 20 to compensate for thermal expansion and the magnet 19 which is maintained by the lugs 23 of the washer 20, The previously formed compact and pre-centered unit, The steel plate 21*a* which forms the base plate for fastening the insulator.

The operations for making an isolator are completed by a single electric weld which fixes the casing 21 to the base plate 21*a*.

Figure 8:
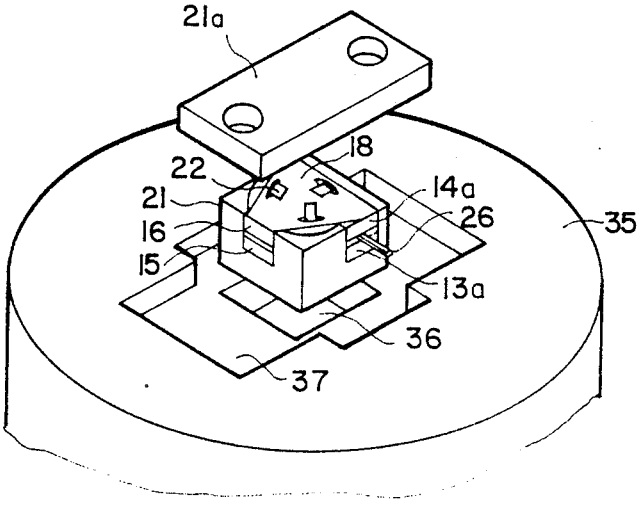
FIG. 8 is a three-dimensional view of the tools used to close the gyromagnetic device of the invention by electric welding.

FIG. 8 illustrates this electric welding operation.

A socket 35 of the electric welding tool has a first housing 36 in which the casing 21 of the isolator is precisely positioned, and a second housing 37 which is used to position, also precisely, the base plate 21*a* with respect to the casing. The assembly is pressed between two electrodes, between there flows an electric current which finally closes the gyromagnetic device by welding the base plate 21*a* to the casing 21. This welding is done in keeping with the positioning dimensions, in particular by means of a metallic ridge, supported by the casing 21, which bites into the base plate 21*a*. During the welding operation, the expansion-compensating washer is compressed to a pre-determined size in such a way that the internal components are subjected to constant pressure.

After the casing is closed by electric welding, the frame 28 is cut so as to be flush with the microstrips 25 and 26. To make the FIG. 8 clearer, the frame 28 is not depicted in it.

The device according to the invention is used essentially in ultra-high frequency equipment, especially radars and telecommunications systems.

Of course, the invention is not restricted to the mode of embodiment which has been described and depicted herein, and covers all technical equivalents of the means described as well as their combinations, should these equivalents and combinations be made in the spirit of the invention and should they be applied within the framework of the following claims.

What is claimed is:

1. A miniaturized and integrated gyromagnetic device comprising;

a casing having a square outer contour;

a center conductor having two sides;

a ferrite wafer disposed on each side of said center conductor and having an outer edge defining a circular contour;

a pair of dielectric wafers each inscribing one of said ferrite wafers and having an outer edge contour corresponding to a triangle;

first and second ground plates sandwiching said wafers;

a magnet disposed adjacent one of said ground plates; and a pressure washer mounted in said casing having, on one side, a plurality of tongues folded at right angles to hold the magnet and, on the other side, a plurality of slanted tongues to absorb the thermal expansion of the device during operation when said casing is closed by electrically welding.

2. A device as in claim 1 wherein said ground plates are non-magnetic, one of said plates having tongues extending toward the other plate and said other plate having slits for receiving said tongues to precisely position said plates and fixedly clamp said conductor, wafers and ground plates together.

3. A device as in claim 2, wherein the outer edge contour of said dielectric wafers is shaped like an isosceles triangle with truncated vertices and corresponds to the outer contour of said ground plates so that said tongues precisely position said ferrite conductors and said wafers.

4. A device as in claim 1 wherein said center conductor includes at least two arms each comprising a microstrip.

5. A device as in claim 1 wherein said center conductor further includes an outwardly extending energy absorbing arm and further including a pair of absorbing blocks in the planes respectively of said dielectric wafers, said absorbing arm being disposed between said blocks.

* * * * *